United States Patent [19]

Pak et al.

[11] 4,102,016

[45] Jul. 25, 1978

[54] SLIVER PLACING DEVICE FOR DRAW FRAMES AND LIKE MACHINE

[76] Inventors: Ivan Dmitrievich Pak, ulitsa Juzhnaya, 29a, kv. 34; Boris Alexeevich Tjukov, ulitsa Uritskogo, 44a/10, kv. 57; Archil Levanovich Karalashvili, Ternovka, ulitsa Experimentalnaya, 4, kv. 33; Jury Nikolaevich Denisov, proezd Kalinina, 2, kv. 9, all of Penza, U.S.S.R.

[21] Appl. No.: 755,547

[22] Filed: Dec. 30, 1976

[51] Int. Cl.[2] ..... B65H 54/80

[52] U.S. Cl. ..... 19/159 R

[58] Field of Search ..... 19/159 R, 159 A; 28/21; 242/83

[56] References Cited

U.S. PATENT DOCUMENTS

| | | | |
|---|---|---|---|
| 1,312,953 | 8/1919 | Cook | 19/159 R |
| 3,061,229 | 10/1962 | Crum | 242/83 |
| 3,233,290 | 2/1966 | Defore | 19/159 R |
| 3,848,297 | 11/1974 | Ohashi et al. | 19/159 R |

*Primary Examiner*—Dorsey Newton

*Attorney, Agent, or Firm*—Steinberg & Blake

[57] ABSTRACT

The present invention relates to devices for placing sliver in a can and can be effectively used in high-speed draw frames with sliver delivery speeds as high as 200 m/min and even higher. The device comprises a rotatable can with a movable bottom that can be lifted and lowered by means of a flexible rod made up of several portions. The upper portion of the rod includes the rotatable base for the movable bottom, the intermediate portion thereof is a flexible and has with bearing abutments, while the lower portion of the rod is a carriage coupled with the rotatable support via a flexible but non-stretchable tensioned member which is kept in permanent engagement with the bearing abutments, to provide for an adequate rigidity of the flexible rod portion when the latter either lifts or lowers the movable bottom.

6 Claims, 5 Drawing Figures

SLIVER PLACING DEVICE FOR DRAW FRAMES AND LIKE MACHINE

BACKGROUND OF THE INVENTION

The invention relates to machinery for pre-spinning treatment of fibres and, more particularly, it relates to sliver placing devices or coilers for draw frames and like machines.

The invention can be used to utmost effectiveness in high-speed draw frames with sliver delivery rates as high as 220 to 410 m/min, for feeding open-end spinning frames.

Prior Art

At present, known in the art are draw frames incorporating a device for placing the sliver into a can, commonly called "the coiler," including a movable bottom vertically reciprocable in the can. The bottom is reciprocated by a mechanism made in the form of a vertical rod which lowers to 1.5 m below the floor level within a can-filling cycle.

To control the sliver-placing or coiling density, the known machines include system of counterweights operatively connected with the vertical rod. However, the incorporation of these systems complicates the erection of a machine, and also its operation and maintenance.

In the industry there are also known draw frames with coilers wherein the reciprocation of the movable bottom is effected by means of a pantograph mechanism accommodated within a vertically extending drum of which the uppermost end face supports the can. However, this requires either reducing the height of the can proper or increasing the overall height of the draw frame, e.g. to 2,120 mm, which considerably hampers the operation and maintenance of the drafting device of the machine.

OBJECT AND SUMMARY OF THE INVENTION

It is an object of the present invention to eliminate these disadvantages.

It is the main object of the present invention to provide a sliver placing device for draw frames and like machines: wherein the mechanism for lifting and lowering the movable bottom of the can should be of a structure providing for dense coiling of the sliver, as well as facilitating the assembling and maintenance.

This object is accomplished in a sliver placing device for draw frames and like machines, comprising a rotatable can with a movable bottom that can be vertically reciprocated in the can by the action of the bottom lifting and lowering mechanism, in which device, in accordance with the present invention, said mechanism includes a flexible rod made up of several portions of which the upper portion includes a rotatable support for said movable bottom, the intermediate portion of the rod being flexible and including a plurality of bearing abutments, and the lower portion of the rod including a carriage, the said rotatable support and the said carriage being interconnected by a flexible but non-stretchable tensioned member maintained in a permanent engagement with the bearing abutments, thus providing for the adequate rigidity of the flexible rod portion when the latter is operated to lift and lower the movable bottom. Owing to the herein disclosed structure, dense coiling of the sliver in the can is provided for by the positive downward motion of the flexible rod and, hence, of the movable bottom of the can at a specified rate, which enables to keep the delivery of the sliver under a permanent control. The construction of the flexible rod enables it to flex and thus to follow a curvilinear path, so as to extend parallel with the shop floor, which facilitates the accommodation and erection of the draw frame.

The construction of the members actuating the flexible rod enables to accommodate them within the overall dimensions of the draw frame, whereby these members do not interfere with the operation and maintenance of the drafting device and of other vital assemblies of the frame.

In accordance with the preferred embodiment of the present invention, the flexible rod portion includes a plurality of pivotally interconnected elements or links made integral with the bearing abutments, these bearing abutments being so relatively arranged that when the respective elements of the flexible rod portion follow the horizontal and vertical straight portions of the path of the flexible rod portion, the end faces of the respective bearing abutments firmly contact one another, whereas when, the elements of the flexible rod follow the curvilinear portion of the path of the rod, gaps appear between the end faces of the respective adjacent abutments, the length of each bearing abutment equalling the spacing between the adjacent pivots interconnecting the elements of the flexible rod. The above-specified structure of the flexible rod enables it to act as a rigid stem along the horizontal and vertical straight portions of its path, and also to flex exactly over the area when the direction of this path changes, i.e., along the curvilinear portion of the path.

The said structure provides for accommodating the flexible rod within the overall dimensions of the draw frame.

BRIEF DESCRIPTION OF THE DRAWINGS

The present invention will be better understood from the following description of an embodiment thereof, with reference being had to the accompanying drawings, wherein.

DETAILED DESCRIPTION OF THE INVENTION

Figure 1:
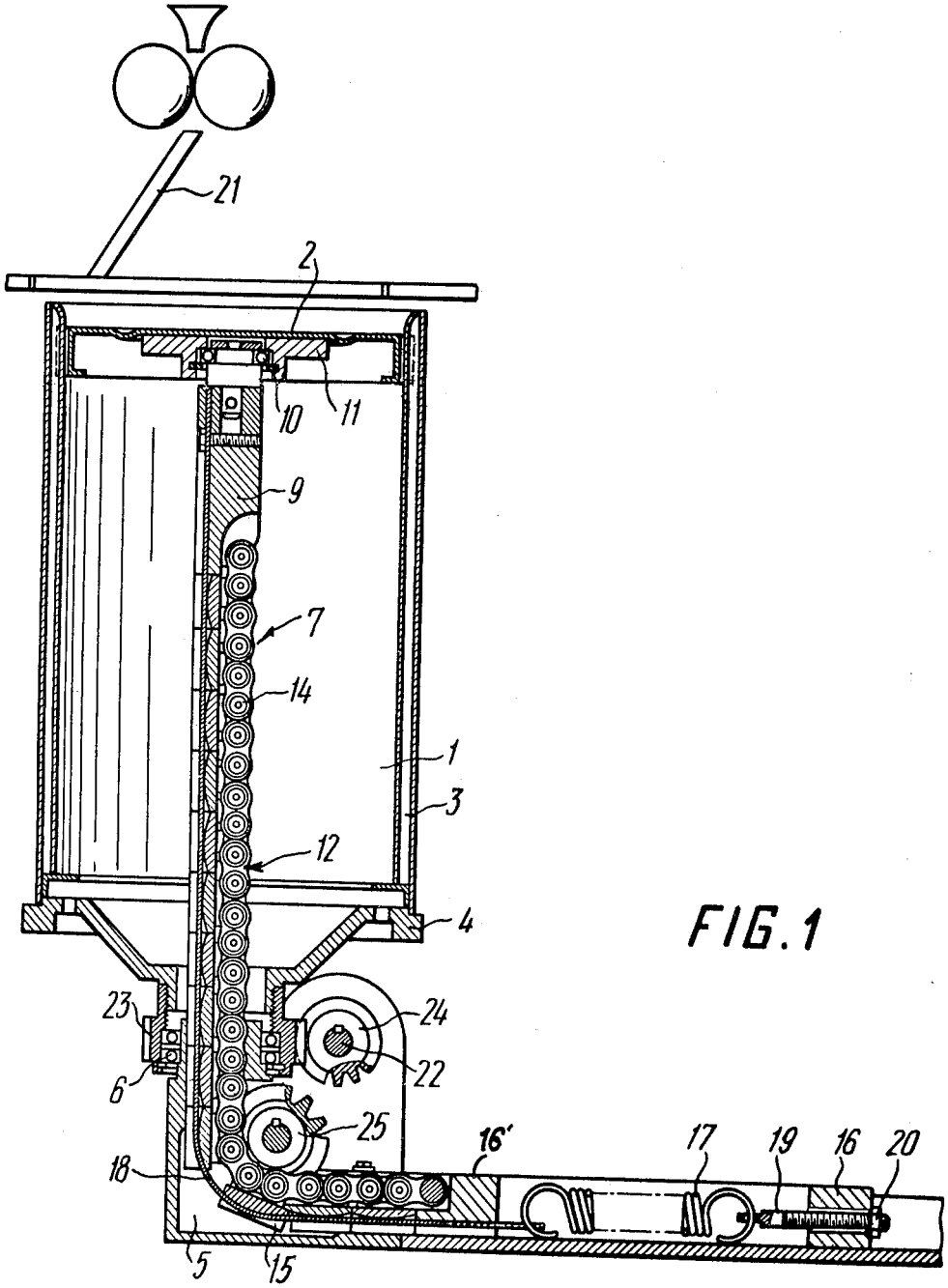
FIG. 1 is a longitudinally sectional side view of a device for placing sliver in a can, embodying the invention, at the initial can-filling stage.
Figure 2:
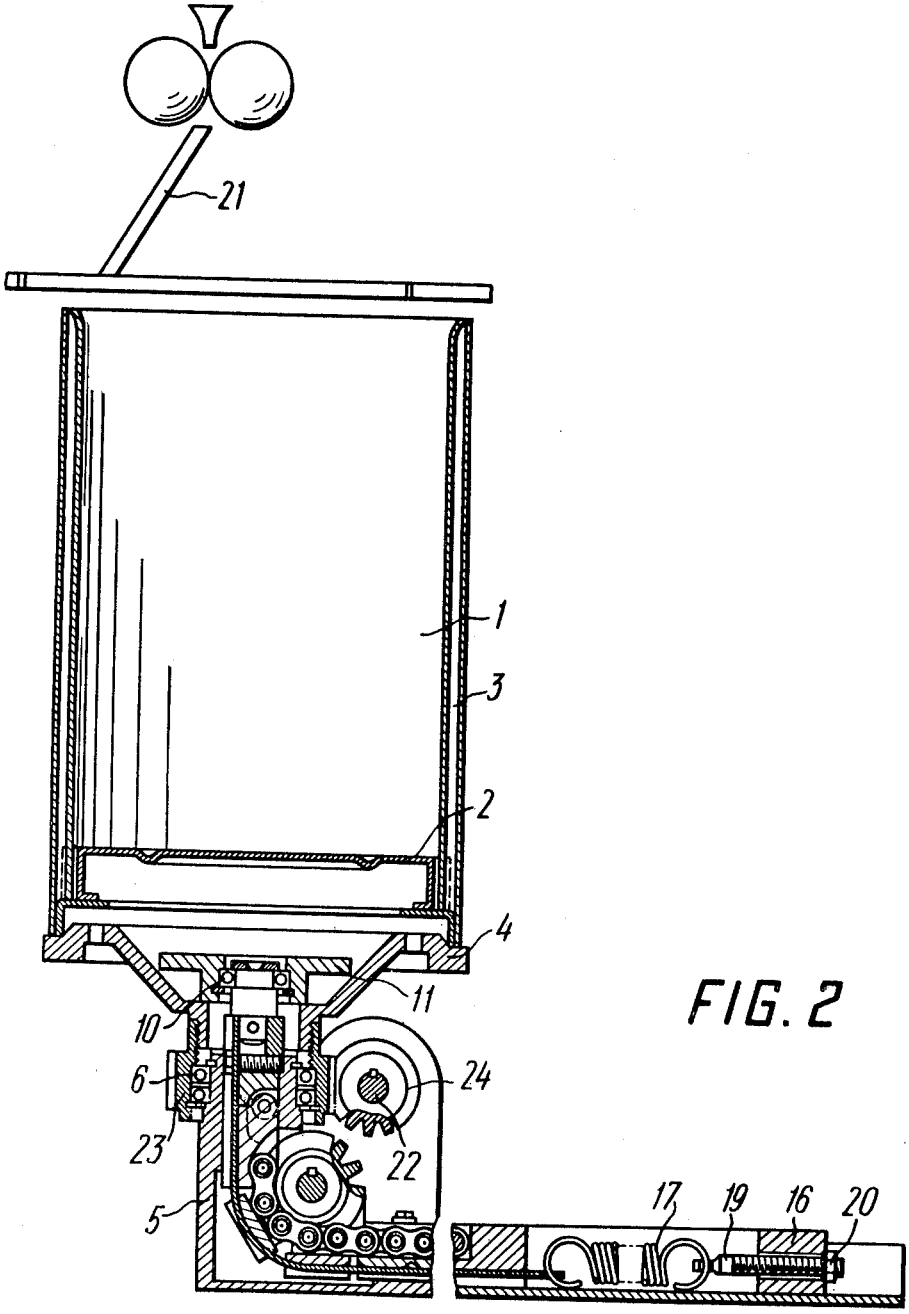
FIG. 2 shows the same as FIG. 1, at the end of the canfilling cycle.
Figure 3:
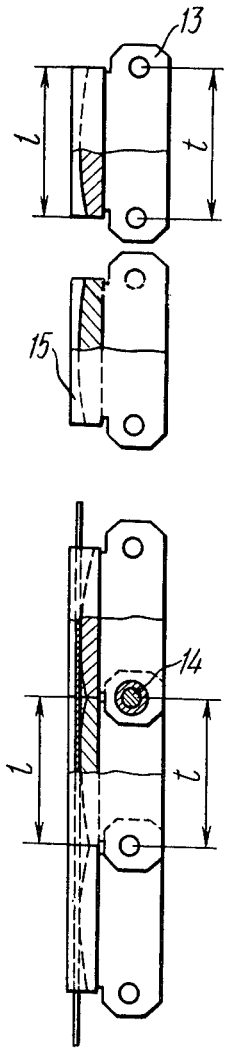
FIG. 3 shows on an enlarged scale the elements of the flexible rod portion.
Figure 4:
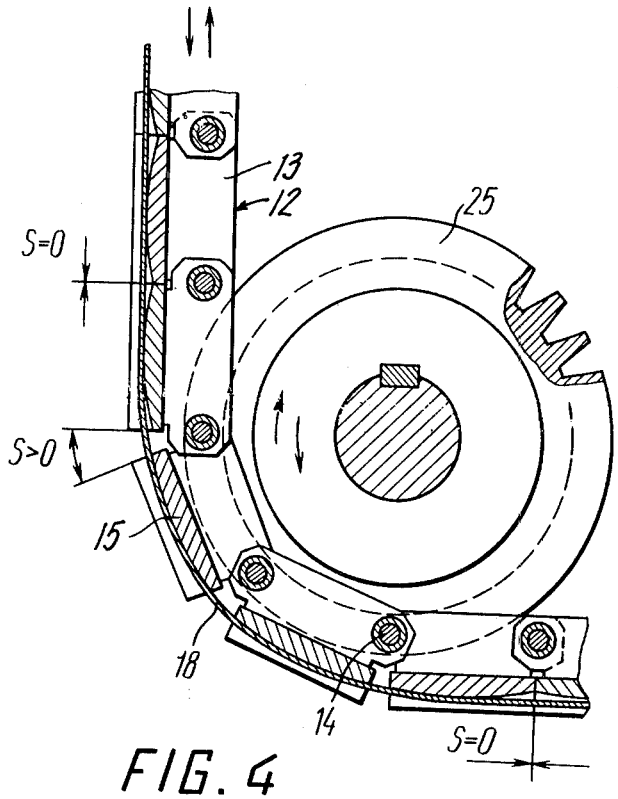
FIG. 4 illustrates the position of the elements of the flexible rod portion, as they follow the curvilinear portion of the path, i.e., move about the driving sprocket.

Referring now in particular to the appended drawings, the sliver placing device or coiler includes a can 1 (FIGS. 1 and 2) provided with a movable bottom 2 that can be vertically reciprocated along the entire vertical extent of the can 1. In addition to the movable bottom 2 the can 1 is provided with guides 3 providing for operative connection between the movable bottom 2 and the walls of the can 1. In this way there is ensured the joint rotation of the movable bottom 2 and of the can 1 at the same speed. The can 1 is mounted on the plate 4 of the bottom coiler arrangement, which plate 4 is journalled in the housing 5 by means of an antifriction bearing 6. A flexible rod means 7 adapted to lower and lift the movable bottom 2 is made up of several portions. The upper portion 9 of the rod means 7 is a housing with a bearing 10 rotatably supporting the rotating base 11 of the movable bottom 2. The rotatable base 11 enhances the stability of the movable bottom 2 in operation of the draw frame. The provision of the bearing 10 prevents transmission of the torque from the rotating can 1 with the movable bottom 2 to the non-rotating flexible rod 7. An intermediate flexible rod portion 12 of the rod means 7 includes a plurality of elements or links 13 interconnected by pivots 14 (FIG. 3). Each element 13 of the flexible rod portion 12 is made integral with a bearing abutment 15, the abutments 15 of the elements 13 being so relatively arranged, that when the elements 13 of the articulated rod portion 12 follow the vertical and horizontal straight portions of the path of the rod portion 12, the respective end faces of the adjacent abutments 15 firmly engage each other. As can be seen in FIG. 4, the gap "*s*" therebetween in this case equalling zero, whereas when the elements 13 follow the curvilinear portion of this path, i.e., the portion when the path changes its direction, there appear gaps "*s*" between these end faces which have a definite extent, i.e., "*s*" > 0. The length "1" of each bearing abutment 15 equals the spacing "*t*" between the adjacent pivots 14. This structure of the elements enables the flexible rod portion 12 to flex only to one side.

The lower portion of the flexible rod means 7 includes a carriage block 16′ (FIG. 1) associated with a spring means 17 having one end thereof coupled with a flexible but non-stretchable tensioned strip or member 18 and the other end connected to a screw 19 adjustable in the body of the carriage 16 by means of an adjustment nut 20. The tensioned member 18 connects the base 11 to the carriage block 16′ and is maintained at all times under tension by the spring means 17.

Besides, the base 11 and the carriage block 16′ are connected with the flexible rod portion 12 by means of respective pivots 14 at the extremities of this flexible rod portion. The tensioned member 18 runs at the side of the bearing abutments 15, its action opposing the tendency of the flexible rod portion 12 to bend along the straight portions of its path. By tensioning the strip or member 18 with the spring means 17 to a desired degree by rotating the adjustment nut 20, it is possible to ensure a permanent engagement of the tensioned strip or member 18 with the bearing abutments 15, in which way there is ensured an adequate rigidity and stability of the flexible rod along the vertical portion of its path, as it is operated to lift and lower the movable bottom 2 of the can 1. Thus, spring 17 and strip 18 form a stiffening means engaging the flexible rod portion 12 particularly at its upright vertical part to lend rigidity thereto and thus prevent buckling thereof.

Figure 5:
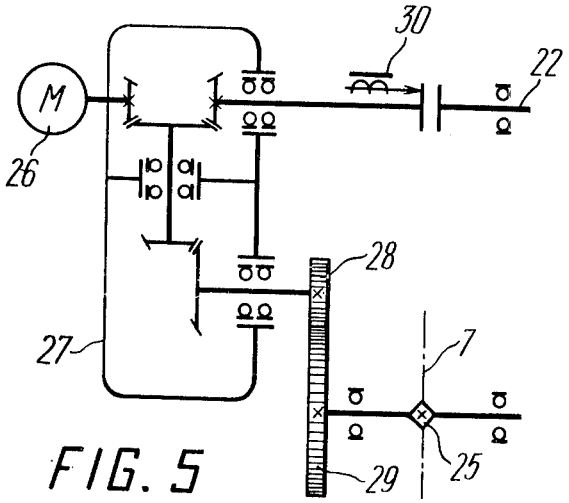
FIG. 5 schematically illustrate the driving train of the device.

The device also includes an upper plate with a sliver guide 21 directing the sliver into the can. The bottom plate 4 is operatively connected with a drive shaft 22 by means of a gear couple 23 and 24. The flexible rod means 7 is actuated by a driving sprocket 25 rotatable by an independent electric motor 26 (FIG. 5) through a reducing gear transmission 27 and gears 28, 29. The driving sprocket 25 is operatively connected with the driving shaft 22 of the bottom plate 4 through the reducing gear transmission 27 and an electromagnetic clutch 30.

The herein disclosed device operates, as follows.

When a can 1 is placed to receive the sliver, the electric motor 26 is energized and transmits rotation to the driving sprocket 25 through the reducing gear transmission 27 and the gear couple 28, 29. The driving sprocket 25 which engages the elements 13 of the flexible rod portion 12 actuates the flexible rod means 7, which lifts the bottom 2 in a fast motion. When the bottom 2 is driven up to its topmost position, the electric motor 26 is deenergized, and when the draw frame is started, the electromagnetic clutch 30 is engaged, whereby the driving sprocket 25 receives rotation from the driving shaft 22 of the bottom plate 4. This shaft 22, with the draw frame started, rotates and transmits rotation to the bottom plate 4 via the gears 23 and 24. The movable bottom 2 lowers along the guides 3 of the can 1, while at the same rotating with the latter.

Thus, as the sliver is delivered into the can 1, the flexible rod means 7 is driven downward at a preset speed, which provides a permanent control over the placing of the sliver in the can 1. Depending on the count of the sliver and the required amount of the sliver in the can, the lowering speed of the flexible rod means 7 can be varied with aid of the reducing gear transmission 27. The structure of the flexible rod means 7 enables it to run about the driving sprocket 25 in engagement therewith and at the same time to retain the required rigidity throughout its working or vertical length. When the required length of the sliver has been delivered, the electromagnetic clutch 30 is disengaged, and the electric motor 26 is energized. As is apparent from FIG. 1, the carriage 16′ block which forms the lower portion of the flexible rod means 7 moves in a generally horizontal direction along the floor which is formed by the bottom wall of the housing 5.

The movable bottom 2 is lowered in a fast motion into its lowermost position, by the flexible rod means 7 being retracted by the driving sprocket 25 through the opening in the housing 5 along the horizontal portion of its path, i.e. along the floor. When the movable bottom 2 is lowered into its lowermost position, the electric motor 26 is deenergized. Then the filled can is replaced with an empty one, and the abovedescribed filling cycle is repeated.

The herein disclosed coiler is capable of dense coiling of sliver to a weight of 6 kg into cans 220 mm in diameter, which are employed in the processing lines supplying with sliver present-day open-end spinning frames. Instead of the abovedescribed chain-like flexible rod portions, there can be used a toothed belt of a suitable specific structure, a rope and other kinds of flexible rod portions having the abovespecified bearing abutments maintained in a permanent engagement with a tensioned flexible but non-stretchable member providing the required rigidity of the flexible means.

What we claim is:

1. A sliver placing device for draw frames and like machines, comprising a rotatable can adapted to have a sliver placed thereinto; means for imparting rotation to said can; a bottom forming part of said can and being movable in the process of placing the sliver thereupon; a flexible rod means for lifting and lowering said bottom and being made up of several portions including an upper portion having a rotatable base for said bottom, an intermediate flexible rod portion having bearing abutments, and a lower portion having a carriage block; a tensioned, flexible but non-stretchable member connected to said upper portion of said flexible rod means and extending therefrom along said intermediate flexible rod portion, spring means operatively connected with said and tensioned member for maintaining the latter under tension and in permanent contact with the bearing abutments, thus providing for rigidity of said flexible rod portion when the latter is operated to lift and lower said movable bottom, and means operatively connected with said flexible rod means for actuating the latter to lift and lower said movable bottom while moving said flexible rod means along a path having horizontal and vertical straight portions and a curvilinear portion therebetween, with said carriage block of said lower portion of said flexible rod means being movabl along said horizontal portion of said path.

2. A device as set forth in claim 1, wherein said flexible rod portion includes a plurality of pivotally interconnected elements integral with said bearing abutments, these bearing abutments being so relatively arranged that when the respective elements of said flexible rod portion follow the horizontal and vertical straight portions of said path, end faces of the respective ones of said bearing abutments firmly contact one another, whereas when the elements of said flexible rod portion follow the curvilinear portion of said path, gaps appear between the end faces of the respective adjacent abutments, the length of each bearing abutment equalling the spacing between adjacent pivots interconnecting said elements of said flexible rod portion.

3. For use in a sliver placing device for draw frames and like machines provided with a can having a movable bottom, elongated flexible rod means connected to and extending downwardly from said movable bottom, said flexible rod means having an upper portion connected with said movable bottom, a lower portion distant from said upper portion, and an intermediate elongated flexible rod portion connected to and extending between said upper and lower portions of said flexible rod means, said flexible rod means being movable along a path having a vertical straight portion extending downwardly from said bottom, a second generally horizontal portion along which said lower portion of said flexible rod means travels, and a curvilinear portion extending between said vertical and second portions of said path, means operatively connected with said flexible rod means for moving the latter along said path, said vertical straight portion of said path becoming longer as said bottom moves upwardly and shorter as said bottom moves downwardly, and stiffening means engaging said portions of said flexible rod means for stiffening and lending rigidity to said intermediate flexible rod portion at least at the part thereof which at any given instant is situated along said vertical portion of said path for preventing buckling of said flexible rod portion at least at the part thereof which is situated along said vertical portion of said path.

4. The combination of claim 3 and wherein said lower portion of said flexible rod means is in the form of a carriage block movable along said second portion of said path, and said stiffening means including a spring means operatively connected to said carriage block and an elongated flexible but non-stretchable strip connected to and extending between said spring means and said upper portion of said flexible rod means and extending along and engaging said intermediate flexible rod portion, said strip being maintained under tension by said spring means and cooperating with said flexible rod portion at least at the part thereof which extends along said vertical portion of said path for stiffening and lending rigidity to the latter part of said flexible rod portion.

5. The combination of claim 4 and wherein said second portion of said path is also straight.

6. The combination of claim 5 and wherein said flexible rod portion is in the form of a series of pivotally interconnected links, said means for moving said flexible rod means along said path including a gear which is rotatable and engages said links at the curvilinear portion of said path.

* * * * *